US009863651B2

(12) United States Patent
Uemura et al.

(10) Patent No.: US 9,863,651 B2
(45) Date of Patent: Jan. 9, 2018

(54) OUTDOOR UNIT FOR AIR-CONDITIONING APPARATUS

(71) Applicants: Takamasa Uemura, Tokyo (JP); Susumu Yoshimura, Tokyo (JP); Hiroaki Nakamune, Tokyo (JP); Kenichi Sakoda, Tokyo (JP)

(72) Inventors: Takamasa Uemura, Tokyo (JP); Susumu Yoshimura, Tokyo (JP); Hiroaki Nakamune, Tokyo (JP); Kenichi Sakoda, Tokyo (JP)

(73) Assignee: MITSUBISHI ELECTRIC CORPORATION, Chiyoda-Ku, Tokyo (JP)

( * ) Notice: Subject to any disclaimer, the term of this patent is extended or adjusted under 35 U.S.C. 154(b) by 237 days.

(21) Appl. No.: 14/651,691

(22) PCT Filed: Dec. 12, 2012

(86) PCT No.: PCT/JP2012/007920

§ 371 (c)(1),
(2) Date: Jun. 12, 2015

(87) PCT Pub. No.: WO2014/091521

PCT Pub. Date: Jun. 19, 2014

(65) Prior Publication Data

US 2015/0316277 A1 Nov. 5, 2015

(51) Int. Cl.
*F25D 17/06* (2006.01)
*F24F 5/00* (2006.01)
(Continued)

(52) U.S. Cl.
CPC ..... *F24F 5/001* (2013.01); *F24F 1/16* (2013.01); *F24F 1/18* (2013.01); *F24F 1/38* (2013.01)

(58) Field of Classification Search
CPC ..... F24F 5/001; F24F 1/16; F24F 1/18; F24F 1/38
(Continued)

(56) References Cited

U.S. PATENT DOCUMENTS 4,470,271 A 9/1984 Draper et al.
5,573,059 A * 11/1996 Hamamoto ..... F24F 1/0007 165/122
(Continued)

FOREIGN PATENT DOCUMENTS

CN 202188569 U 4/2012
JP 48-9462-01 2/1973
(Continued)

OTHER PUBLICATIONS

Office Action (First Office Action) dated Nov. 16, 2016, by the Chinese Patent Office in corresponding Chinese Patent Application No. 201280077644.X, and an English Translation of the Office Action. (8 pages).
(Continued)

*Primary Examiner* — Melvin Jones
(74) *Attorney, Agent, or Firm* — Buchanan Ingersoll & Rooney PC

(57) ABSTRACT

An outdoor unit for an air-conditioning apparatus includes at least a heat exchanger, a fan, a compressor, and a box-like casing housing these components and having an air inlet and an air outlet. The compressor is arranged at a location other than an air passage in which air having flowed in through the air inlet flows through the heat exchanger and the fan to the air outlet. The heat exchanger includes a plurality of heat exchange portions, and these heat exchange portions are arranged in a zigzag shape.

9 Claims, 6 Drawing Sheets

(51) Int. Cl.
*F24F 1/18* (2011.01)
*F24F 1/38* (2011.01)
*F24F 1/16* (2011.01)

(58) Field of Classification Search
USPC ..... 62/426, 498, 324.1
See application file for complete search history.

(56) References Cited

U.S. PATENT DOCUMENTS

| | | | | |
|---|---|---|---|---|
| 2006/0168982 | A1* | 8/2006 | Moon | F24F 1/0007 62/324.1 |
| 2012/0061139 | A1* | 3/2012 | Bianchetti | H01R 4/68 174/75 R |

FOREIGN PATENT DOCUMENTS

| | | | |
|---|---|---|---|
| JP | 52-149448 | | 11/1977 |
| JP | 3-64360 | U | 6/1991 |
| JP | 5-312352 | A | 11/1993 |
| JP | 9-217949 | A | 8/1997 |
| JP | 10-213331 | A | 8/1998 |
| JP | 10-300129 | A | 11/1998 |
| JP | 2000-55409 | A | 2/2000 |
| JP | 2003-120588 | A | 4/2003 |
| JP | 2006-57864 | A | 3/2006 |
| JP | 2009-52534 | A | 3/2009 |
| JP | 2010-121895 | A | 6/2010 |

OTHER PUBLICATIONS

International Search Report (PCT/ISA/210) dated Jan. 29, 2013, by the Japanese Patent Office as the International Searching Authority for International Application No. PCT/JP2012/007920.
Written Opinion (PCT/ISA/237) dated Jan. 29, 2013, by the Japanese Patent Office as the International Searching Authority for International Application No. PCT/JP2012/007920.
European Search Report dated Sep. 15, 2016 issued in corresponding European Patent Appln. No. 2890089.1 (7 pages).

* cited by examiner

B–B

OUTDOOR UNIT FOR AIR-CONDITIONING APPARATUS

TECHNICAL FIELD

The present invention relates to an outdoor unit for an air-conditioning apparatus.

BACKGROUND ART

An existing outdoor unit for an air-conditioning apparatus includes components such as a heat exchanger, a fan, and a compressor, and a box-like casing which houses these components. The outdoor unit circulates refrigerant between the outdoor unit and an indoor unit connected thereto via a pipe and causes the refrigerant and air flowing through the heat exchanger to reject heat or remove heat therebetween, thereby cooling or heating a room. For such an existing outdoor unit for an air-conditioning apparatus, as a structure which improves the performance of an air-conditioning apparatus by increasing heat-rejecting efficiency or heat-removing efficiency, a structure has been proposed in which in order that two surfaces of a box-like casing can be utilized, a heat exchanger is arranged in an L shape along the two surfaces, or a structure has been proposed in which in order that three surfaces of a box-like casing can be utilized, a heat exchanger is arranged in substantially a U shape along the three surfaces by modifying the arrangement of a compressor (e.g., see Patent Literature 1).

CITATION LIST

Patent Literature

Patent Literature 1: Japanese Unexamined Patent Application Publication No. 2006-57864 ([0012], [0020], FIG. 1, and FIG. 3)

SUMMARY OF INVENTION

Technical Problem

As for the existing outdoor unit for an air-conditioning apparatus, as one method for further improving the performance without increasing the unit size, it is conceivable to arrange a heat exchanger along a top plate or bottom plate surface. However, such a methodentails limitations in installation of the outdoor unit, for example, it is necessary to provide a sufficient space for suction near the top plate or bottom plate surface. In addition, a decrease in productivity such as complication of assembling is caused. Moreover, since a space in which the heat exchanger can be arranged is limited as described above, there is a limitation on an increase in the mounting volume of the heat exchanger.

As for the existing outdoor unit for an air-conditioning apparatus, as another method for further improving the performance without increasing the unit size, it is also conceivable to form a heat exchanger such that the heat exchanger is thick in an air flow direction. However, in such a method, the temperature difference between air and refrigerant is decreased at a more downstream side of air. Thus, improvement in the heat exchange performance is saturated with an increase in thickness. Furthermore, since air flow resistance, that is, fan input increases substantially in proportion to the thickness of the heat exchanger, even when the thickness of the heat exchanger is increased to increase the mounting volume thereof, it is not possible to expect improvement in the performance of the outdoor unit which corresponds to the increase in the mounting volume. Moreover, when the air volume is increased, the above-stated decrease in the temperature difference between the air and the refrigerant is suppressed, and the heat exchange performance increases substantially in proportion to the air volume. However, with increase in the speed of air flowing through the heat exchanger, the air flow resistance, that is, the fan input increases more than this, and thus it is not possible to efficiently improve the performance of the outdoor unit.

As described above, the existing outdoor unit for an air-conditioning apparatus has a problem in that the unit size has to be increased in order to cause the heat exchanger to efficiently operate to improve the performance of the outdoor unit.

The present invention has been made in order to solve the above-described problem, and an object of the present invention is to obtain an outdoor unit which increases a mounting volume of a heat exchanger without increasing a unit size, to achieve both improvement in heat exchange performance and suppression of an increase in air flow resistance to allow the performance to be efficiently improved.

Solution to Problem

An outdoor unit for an air-conditioning apparatus according to the present invention includes a heat exchanger; a fan; a compressor; and a box-like casing housing the heat exchanger, the fan, the compressor, the box-like casing having an air inlet and an air outlet, wherein the heat exchanger includes a plurality of heat exchange portions arranged in an air passage formed between the air inlet and the air outlet, and the heat exchanger has a zigzag shape including at least three bend portions.

Advantageous Effects of Invention

In the outdoor unit according to the present invention, since the heat exchanger housed in the casing includes the plurality of heat exchange portions and the heat exchange portions are arranged in a zigzag shape, it is possible to increase the volume of the heat exchanger without increasing the unit size. In addition, since the heat exchanger is mounted in the casing in order to increase a suction area thereof, both an increase in the heat exchange performance and a reduction in fan input which is caused by a decrease in air flow resistance are achieved, and even when an air volume is increased, it is possible to improve the heat exchange performance while an increase in air flow resistance, that is, an increase in fan input is suppressed.

DESCRIPTION OF EMBODIMENTS

Embodiment 1

Figure 1:
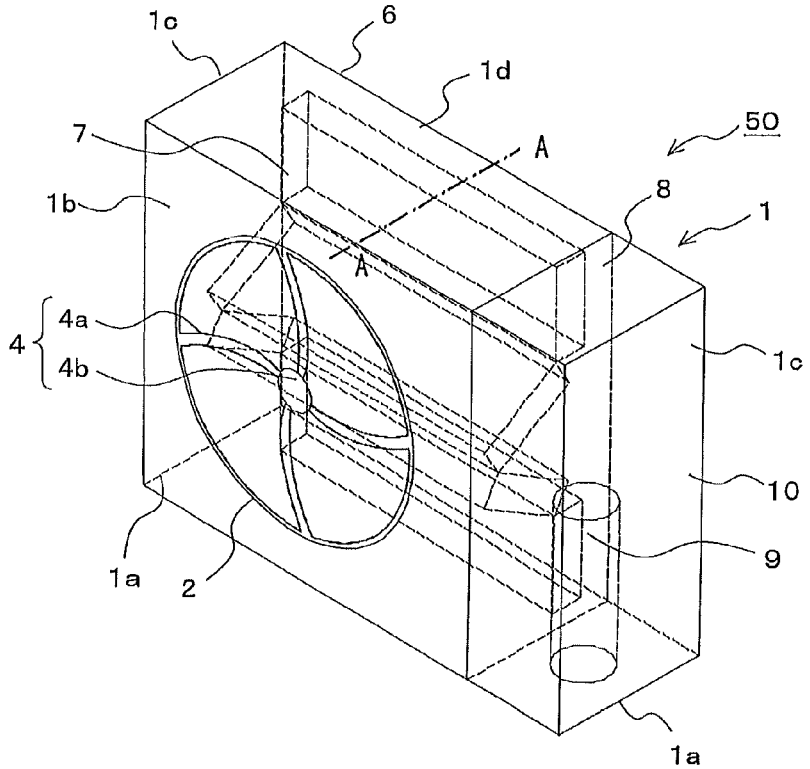
FIG. 1 is an external perspective view showing an outdoor unit for an air-conditioning apparatus according to Embodiment 1 of the present invention.
Figure 2:
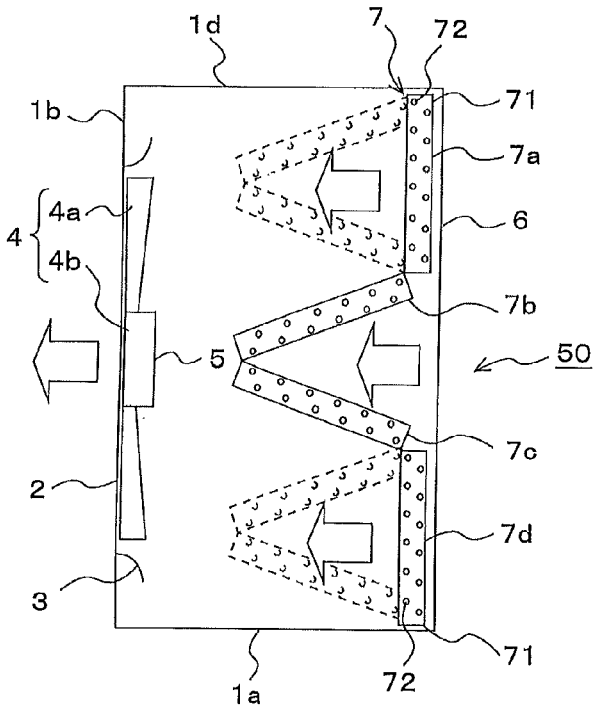
FIG. 2 is a schematic cross-sectional view taken along a line A-A in FIG. 1.
Figure 3:
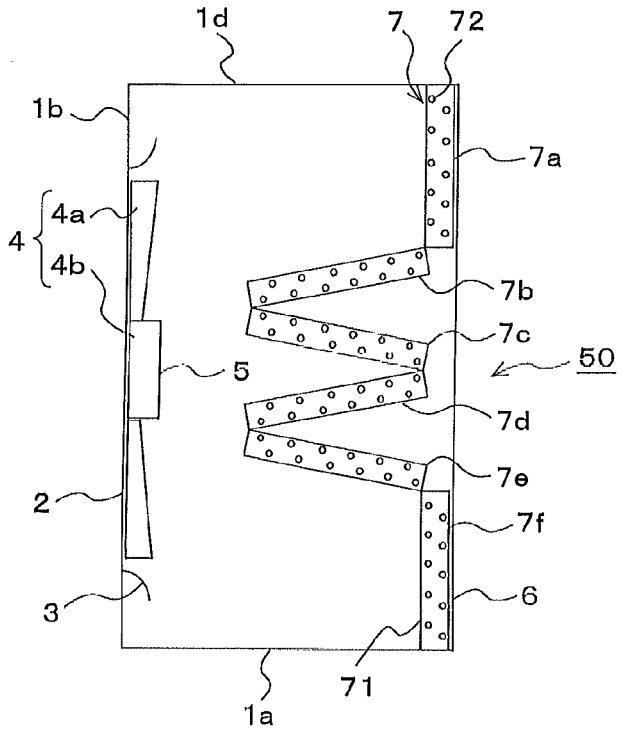
FIG. 3 is a schematic cross-sectional view showing another example of the outdoor unit for an air-conditioning apparatus according to Embodiment 1 of the present invention.
Figure 4:
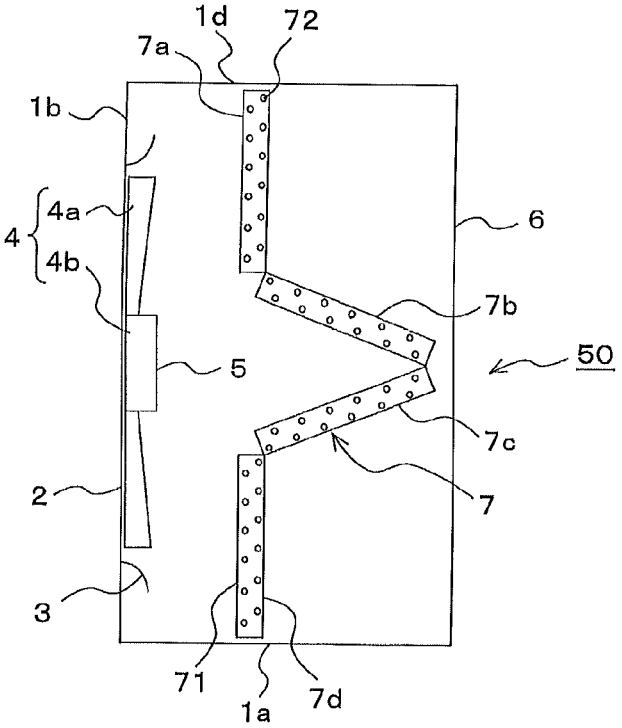
FIG. 4 is a schematic cross-sectional view showing still another example of the outdoor unit for an air-conditioning apparatus according to Embodiment 1 of the present invention.

FIG. 1 is an external perspective view showing an outdoor unit 50 for an air-conditioning apparatus according to Embodiment 1 of the present invention. FIG. 2 is a schematic cross-sectional view taken along a line A-A in FIG. 1. FIG. 3 is a schematic cross-sectional view showing another example of the outdoor unit 50 for an air-conditioning apparatus according to Embodiment 1 of the present invention. FIG. 4 is a schematic cross-sectional view showing still another example of the outdoor unit 50 for an air-conditioning apparatus according to Embodiment 1 of the present invention. It should be noted that outline arrows shown in FIG. 2 indicate flow of air flowing through the outdoor unit 50.

As shown in FIG. 1, the outdoor unit 50 includes a box-like casing 1 having an air inlet 6 and an air outlet 2.

The casing 1 includes, for example, a base plate 1*a* which is a bottom portion, a front panel 1*b* which forms a front portion and has the air outlet 2, a side panel 1*c* which forms a side portion and a rear portion other than a range that serves as the air inlet 6, and a top plate 1*d* which forms a top portion. Within the casing 1, a heat exchanger 7 and a compressor 9 are fixed on the base plate 1*a*, and a fan 4 is mounted via a stay. The fan 4 is opposed to the air outlet 2, and a bell mouth 3 is provided at an outer peripheral portion of the air outlet 2 so as to surround an outer peripheral portion of the fan 4. Within the casing 1, an air passage is formed in which air having flowed in through the air inlet 6 flows through the heat exchanger 7 and the fan 4 to the air outlet 2 by the fan 4 being driven. The compressor 9 is fixed to a portion other than the air passage. In Embodiment 1, the interior of the casing 1 is partitioned by a partition plate 8 into a machine chamber 10 in which the compressor 9 is provided and the air passage in which the heat exchanger 7 and the fan 4 are provided.

The fan 4 is an axial flow fan and includes a boss 4*b*, a plurality of vanes 4*a* provided at an outer peripheral portion of the boss 4*b*, and a fan motor 5 which rotates the boss 4*b* and the vanes 4*a* about the center of the boss 4*b* as a rotation axis. In Embodiment 1, the thicknesses of the vanes 4*a* in a rotation axis direction are decreased by reducing the vane width or increasing the number of the vanes. In addition, although not shown, the fan motor 5 is provided within the boss 4*b*. Thus, motor sound is blocked (noise is reduced), and a space in the outdoor unit is ensured (the performance is improved by an increase in heat exchange volume or the cost is reduced by a decrease in the thickness of the outdoor unit).

Next, an operation of the outdoor unit 50 according to Embodiment 1 will be described.

As indicated by the outline arrows in FIG. 2, flow of air generated with the fan 4 enters through the air inlet 6 into the air passage formed by the base plate 1*a*, the front panel 1*b*, the side panel 1*c*, and the top plate 1*d*, and is discharged through the air outlet 2. That is, by the fan 4 being driven, air near the outdoor unit 50 flows through the air inlet 6 into the air passage, flows through between fins 71 of the heat exchanger 7 arranged within the air passage, and is discharged through the air outlet 2. The air flowing through between the fins 71 of the heat exchanger 7 exchanges heat with the heat exchanger 7.

Here, as shown in FIG. 2, the heat exchanger 7 is divided into four heat exchange portions (heat exchange portions 7*a*, 7*b*, 7*c*, and 7*d*), and these heat exchange portions 7*a* to 7*d* are aligned in a vertical direction and arranged in a zigzag shape. That is, the heat exchanger 7 according to Embodiment 1 has three bend portions (portions at which end portions of the heat exchange portions are connected to each other). The heat exchanger 7, that is, the heat exchange portions 7*a* to 7*d* include the fins 71 and heat-transfer pipes 72. The fins 71 are stacked in a horizontal direction at regular intervals such that gaps through which air flows are formed.

Here, the "vertical direction" described in Embodiment 1 does not indicate a direction which strictly agrees with the direction of gravity and may be slightly inclined from the direction of gravity. That is, additionally, the "vertical direction" described in Embodiment 1 indicates substantially the vertical direction. In addition, the "horizontal direction" described in Embodiment 1 does not indicate a direction which strictly agrees with a direction which perpendicularly intersects the direction of gravity, and may be slightly inclined from the direction which perpendicularly intersects the direction of gravity. That is, additionally, the "horizontal direction" described in Embodiment 1 indicates substantially the horizontal direction.

As shown in FIG. 2, the heat exchange portion 7*a* located at the uppermost portion of the heat exchanger 7 according to Embodiment 1 and the heat exchange portion 7*d* located at the lowermost portion of the heat exchanger 7 are arranged perpendicularly to an air suction direction in which air is sucked through the air inlet 6 in the outdoor unit 50, as seen from the outline arrows in FIG. 2. Thus, the resistance applied to air flowing through the heat exchange portion 7*a* and the heat exchange portion 7*d* is reduced, and the air easily passes through the heat exchange portion 7*a* and the heat exchange portion 7*d*. As a result, it is possible to keep a wind speed distribution in the heat exchanger 7 uniform.

In Embodiment 1, the number of bends in the heat exchanger 7 (i.e., the number of connection portions between the heat exchange portions constituting the heat exchanger 7) is three, but is not limited to this number. For example, the number of bends in the heat exchanger 7 may be four or more as shown in FIG. 3. In addition, the number of the heat exchange portions of the heat exchanger 7 that are arranged obliquely with respect to the air suction direction is also not limited. In this case, the air flow resistance is also increased, and thus it is better to appropriately select specifications of the heat exchanger 7 such as thinning the heat exchanger 7.

As described above, the heat exchanger 7 according to Embodiment 1 includes the heat exchange portion 7*a* at the uppermost portion and the heat exchange portion 7*d* at the lowermost portion which are arranged perpendicularly to the air suction direction, and the two heat exchange portions 7*b* and 7*c* which are arranged obliquely with respect to the air suction direction. That is, this structure is a structure in which bends at the uppermost portion and the lowermost portion of the heat exchanger 7 are omitted in the case where the number of bends in the heat exchanger 7 is four or more and all heat exchange portions are arranged obliquely with respect to the air suction direction. In the outdoor unit 50 configured in Embodiment 1, it is possible to increase the mounting volume of the heat exchanger 7 while a decrease in the heat exchange performance of the heat exchanger 7 due to the wind speed distribution is suppressed. In addition, since each heat exchange portion constituting the heat exchanger 7 is arranged in a zigzag shape, it is possible to ensure a sufficiently large suction area of the heat exchanger 7. Thus, it is possible to decrease the speed of air flowing through the heat exchanger 7 to reduce the air flow resistance of the heat exchanger 7, that is, fan input. In addition, even when the air volume is increased in response to an increase in the mounting volume of the heat exchanger 7, the air flow area of the heat exchanger 7 is also increased at the same time, and thus an increase in the speed of air flowing through the heat exchanger 7 is suppressed, and it is possible to efficiently improve the heat exchange performance of the heat exchanger 7 without causing an increase in air flow resistance.

In addition, as shown by the outline arrows in FIG. 2, in the outdoor unit 50 according to Embodiment 1, air sucked through the air inlet 6 substantially linearly flows through the air passage and is discharged through the fan 4. Thus, pressure loss caused by bending, expansion/contraction, or the like of air, that is, so-called form loss is low, most of the pressure loss within the air passage is caused when air flows through the heat exchanger, and thus it is possible to reduce the fan input. Moreover, in the outdoor unit 50 according to Embodiment 1, an inflow condition suitable for the axial flow fan that is a condition that air flows substantially parallel to the rotation axis of the fan 4 is established, and thus the fan efficiency improves. Therefore, less disturbed flow enters into the fan 4 while the fan input is reduced, and hence it is also possible to reduce noise.

In Embodiment 1, the single fan 4 is used, but in the case of increasing the air volume in accordance with an increase in the mounting volume of the heat exchanger 7, a plurality of fans 4 may be used. For example, two fans 4 may be arranged such that a position near the connection portion between the heat exchange portion 7*a* and the heat exchange portion 7*b* (the bend portion between the heat exchange portion 7*a* and the heat exchange portion 7*b*) and a position near the connection portion between the heat exchange portion 7*c* and the heat exchange portion 7*d* (the bend portion between the heat exchange portion 7*c* and the heat exchange portion 7*d*) are central positions of the fans 4.

However, in Embodiment 1, a predetermined air volume is generated with the single fan 4 whose vane diameter is increased. This is because, by generating the predetermined air volume with the single fan 4 whose vane diameter is increased, it is possible to efficiently operate the fan 4 at a relatively low rotation speed and it is possible to reduce noise. As described above, since many heat exchange portions are arranged in a zigzag shape in a range opposed to the single fan 4, that is, since many bend portions are arranged in the range opposed to the single fan 4, it is possible to increase the volume of the heat exchanger with respect to the single fan 4. Thus, it is possible to improve the heat exchange performance without increasing the air flow resistance, that is, the fan input, and it is also possible to improve the efficiency of the fan 4 and reduce noise.

In addition, in Embodiment 1, each heat exchange portion is arranged such that the connection portion between the heat exchange portion 7*a* and the heat exchange portion 7*b* and the connection portion between the heat exchange portion 7*c* and the heat exchange portion 7*d* are close to the air inlet 6, but the arrangement of these heat exchange portions is not limited to this arrangement. For example, as shown in FIG. 4, the heat exchanger 7 may be inverted along the air flow direction, and each heat exchange portion may be arranged such that the connection portion between the heat exchange portion 7*b* and the heat exchange portion 7*c* is close to the air inlet 6.

As described above, in the outdoor unit 50 according to Embodiment 1, the heat exchanger 7 provided within the casing 1 includes a plurality of heat exchange portions, and these heat exchange portions are arranged in a zigzag shape. Thus, it is possible to increase the mounting volume of the heat exchanger 7 without increasing the unit size. In addition, since the heat exchange portion located at the uppermost portion of the heat exchanger 7 and the heat exchanger located at the lowermost portion of the heat exchanger 7 are arranged perpendicularly to the air inflow direction, and the resistance of air passing therethrough is reduced. Thus, it is possible to suppress a decrease in the heat exchange performance of the heat exchanger 7 which is caused due to a wind speed distribution. Moreover, since the heat exchanger 7 is mounted such that the air flow area thereof is increased, both an increase in the heat exchange performance and a reduction in the air flow resistance (i.e., the fan input) are achieved. Furthermore, even when the air volume is increased, while the wind speed distribution in the heat exchanger 7 is kept uniform, it is possible to suppress an increase in the air flow resistance and improve the heat exchange performance.

In addition, when an existing outdoor unit in which a heat exchanger is arranged along a side surface of a casing and the outdoor unit 50 according to Embodiment 1 in which the heat exchanger 7 is formed in a zigzag shape are compared to each other, the following advantageous effects are provided. It should be noted that hereinafter, the volume of the heat exchanger is defined as "a stacking length (the distance between fins arranged at both end portions in a direction in which the fins are stacked)×"the longitudinal length of the fin"×"the lateral length of the fin". In the case of a heat exchanger including a plurality of heat exchange portions as in the heat exchanger 7 according to Embodiment 1, the sum of the volumes of the respective heat exchange portions is defined as the volume of the heat exchanger 7.

When it is assumed that the unit size of the existing outdoor unit and the unit size of the outdoor unit 50 according to Embodiment 1 are the same and the volumes of the heat exchangers provided in both outdoor units are the same, the outdoor unit 50 according to Embodiment 1 can have a larger stacking length (i.e., the sum of the stacking lengths of the respective heat exchange portions) of the heat exchanger 7 than that in the existing outdoor unit, it is possible to decrease the lateral length of each fin 71 (i.e., the thickness of the heat exchanger 7). In addition, the lateral length of each fin and the number of rows of heat-transfer pipes arranged along the lateral direction of the fin have a correspondence relation. Thus, when it is assumed that the unit size of the existing outdoor unit and the unit size of the outdoor unit 50 according to Embodiment 1 are the same and the volumes of the heat exchangers provided in both outdoor units are the same, it is possible to decrease the number of the heat-transfer pipes 72 in the outdoor unit 50 according to Embodiment 1.

That is, as compared to the existing outdoor unit, the outdoor unit 50 according to Embodiment 1 allows the heat exchanger 7 to efficiently operate, and thus it is possible to improve the performance of the outdoor unit 50 without increasing the unit size. In other words, as for the outdoor unit 50 according to Embodiment 1, when an attempt is made to obtain the same performance as that of the existing outdoor unit, it is possible to decrease the volume of the heat exchanger 7 by an amount corresponding to the improvement of the performance, and thus it is possible to reduce the cost.

Embodiment 2

In the outdoor unit 50 shown in Embodiment 1, for example, by providing a heat exchanger 7 configured as follows in the casing 1, it is possible to further increase the mounting volume of the heat exchanger 7 while a decrease in the heat exchange performance of the heat exchanger 7 which is caused due to the wind speed distribution is suppressed. It should be noted that the matters which are not particularly described in Embodiment 2 are the same as in Embodiment 1, and the same functions or components are described with the same reference signs.

Figure 5:
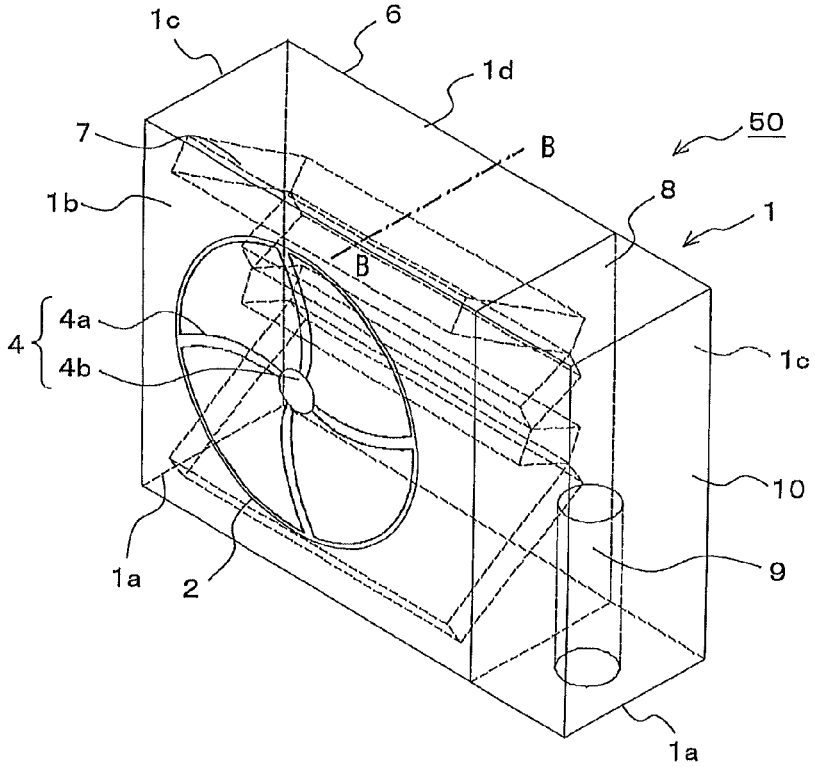
FIG. 5 is an external perspective view showing an outdoor unit for an air-conditioning apparatus according to Embodiment 2 of the present invention.
Figure 6:
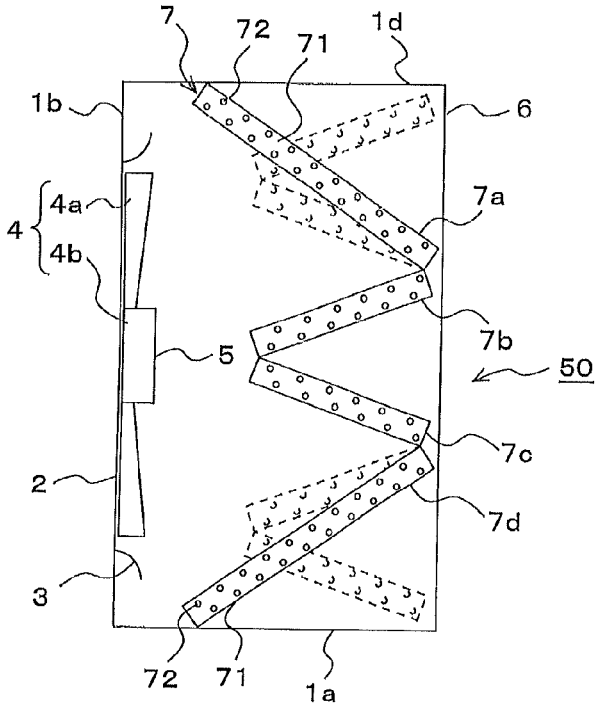
FIG. 6 is a schematic cross-sectional view taken along a line B-B in FIG. 5.
Figure 7:
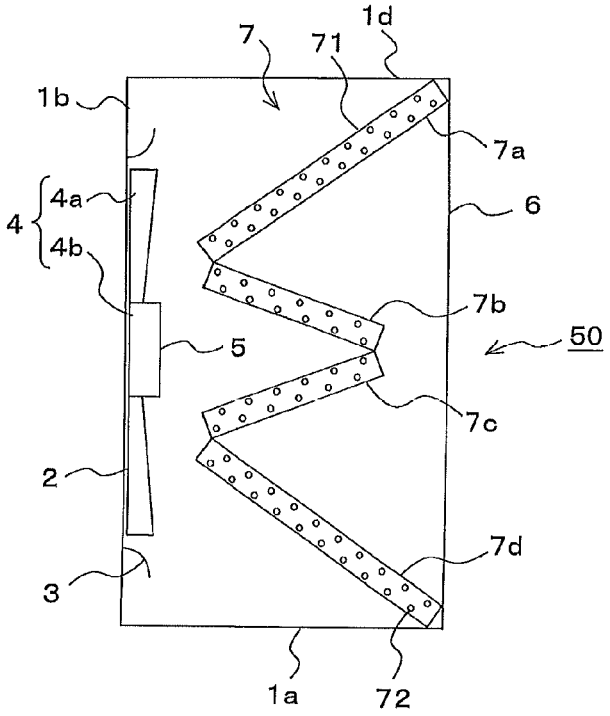
FIG. 7 is a schematic cross-sectional view showing another example of the outdoor unit for an air-conditioning apparatus according to Embodiment 2 of the present invention.

FIG. 5 is an external perspective view showing an outdoor unit 50 for an air-conditioning apparatus according to Embodiment 2 of the present invention. In addition, FIG. 6 is a schematic cross-sectional view taken along a line B-B in FIG. 5. FIG. 7 is a schematic cross-sectional view showing another example of the outdoor unit 50 for an air-conditioning apparatus according to Embodiment 2 of the present invention.

As shown in FIG. 6, the heat exchanger 7 according to Embodiment 2 is divided into four heat exchange portions (heat exchange portions 7*a*, 7*b*, 7*c*, and 7*d*), and these heat exchange portions 7*a* to 7*d* are aligned in the vertical direction. The heat exchanger 7 has three bend portions (portions at which end portions of the heat exchange portions are connected to each other), and the heat exchange portions 7*a* to 7*d* are arranged in a zigzag shape. The heat exchanger 7, that is, the heat exchange portions 7*a* to 7*d* include fins 71 and heat-transfer pipes 72. The fins 71 are stacked in the horizontal direction at regular intervals such that gaps through which air flows are formed.

The heat exchanger 7 according to Embodiment 2 is structured such that the heat exchange portion 7*a* at the uppermost portion and the heat exchange portion 7*d* at the lowermost portion which are arranged perpendicularly to the air inflow direction in the Embodiment 1 are arranged in a zigzag shape, and allows the mounting volumes of the heat exchange portion 7*a* and the heat exchange portion 7*d* to be increased as compared to the case where these heat exchange portions are arranged perpendicularly to the air suction direction. Thus, in the outdoor unit 50 configured in Embodiment 2, similarly to Embodiment 1, it is possible to increase the mounting volume of the heat exchanger 7 while a decrease in the heat exchange performance of the heat exchanger 7 which is caused due to the wind speed distribution is suppressed, as compared to the existing outdoor unit in which a heat exchanger is arranged along a side surface of a casing. In addition, it is possible to further increase the mounting volume of the heat exchanger 7 as compared to Embodiment 1. Moreover, even when the air volume is increased in response to an increase in the mounting volume of the heat exchanger 7, the air flow area of the heat exchanger 7 is also increased at the same time, and thus an increase in the speed of air flowing through the heat exchanger 7 is suppressed, and it is possible to efficiently improve the heat exchange performance of the heat exchanger 7 without causing an increase in air flow resistance.

In Embodiment 2, the number of bends in the heat exchanger 7 (i.e., the number of connection portions between the heat exchange portions constituting the heat exchanger 7) is three, but is not limited to this number. For example, the number of bends in the heat exchanger 7 may be four or more. In addition, the number of the heat exchange portions of the heat exchanger 7 that are arranged in a zigzag shape is also not limited. In this case, the air flow resistance is also increased, and thus it is better to appropriately select specifications of the heat exchanger 7 such as thinning the heat exchanger 7.

In addition, in Embodiment 2, each heat exchange portion is arranged in a zigzag shape such that the connection portion between the heat exchange portion 7*a* and the heat exchange portion 7*b* and the connection portion between the heat exchange portions 7*c* and 7*d* are close to the air inlet 6, but the arrangement of these heat exchange portions is not limited to this arrangement. For example, as shown in FIG. 7, the heat exchanger 7 may be inverted along the air flow direction, and each heat exchange portion may be arranged in a zigzag shape such that the connection portion between the heat exchange portion 7*b* and the heat exchange portion 7*c* is close to the air inlet 6.

Embodiment 3

Figure 8:
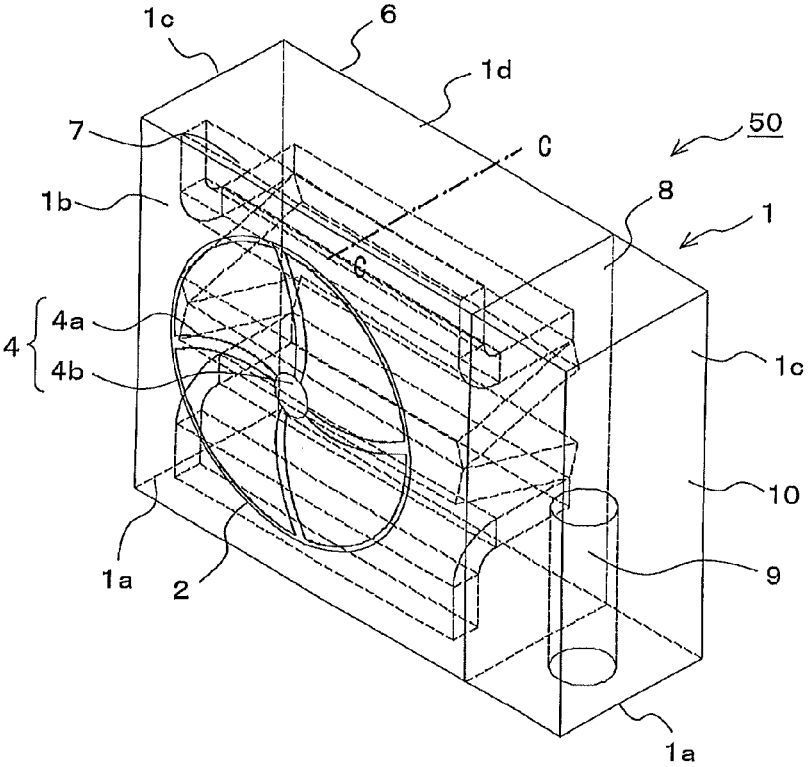
FIG. 8 is an external perspective view showing an outdoor unit for an air-conditioning apparatus according to Embodiment 3 of the present invention.
Figure 9:
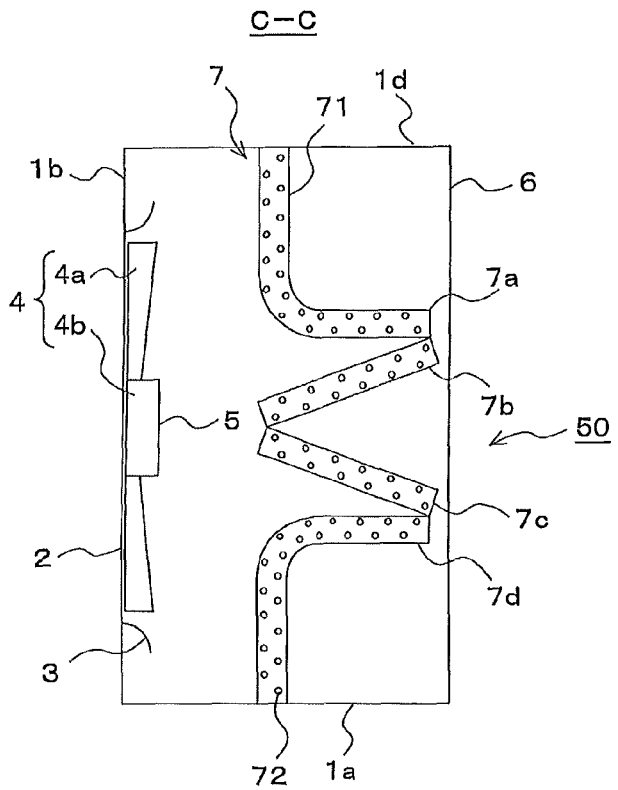
FIG. 9 is a schematic cross-sectional view taken along a line C-C in FIG. 8.
Figure 10:
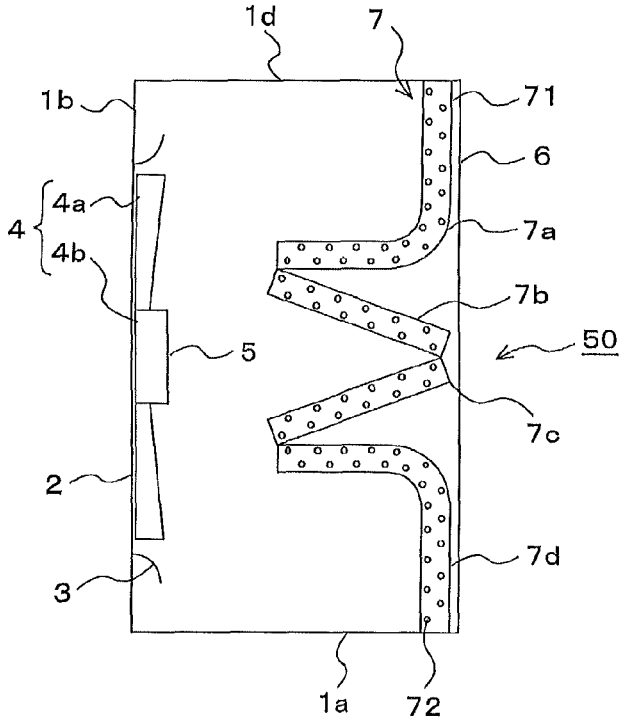
FIG. 10 is a schematic cross-sectional view showing another example of the outdoor unit for an air-conditioning apparatus according to Embodiment 3 of the present invention.

In the outdoor units 50 shown in Embodiments 1 and 2, for example, by providing a heat exchanger 7 configured as follows in the casing 1, it is possible to obtain the same advantageous effects as shown in Embodiments 1 and 2. It should be noted that the matters which are not particularly described in Embodiment 3 are the same as in Embodiments 1 and 2, and the same functions or components are described with the same reference signs. FIG. 8 is an external perspective view showing an outdoor unit 50 for an air-conditioning apparatus according to Embodiment 3 of the present invention. In addition, FIG. 9 is a schematic cross-sectional view taken along a line C-C in FIG. 8. FIG. 10 is a schematic cross-sectional view showing another example of the outdoor unit 50 for an air-conditioning apparatus according to Embodiment 3 of the present invention.

As shown in FIG. 9, the heat exchanger 7 according to Embodiment 3 is divided into four heat exchange portions (heat exchange portions 7*a*, 7*b*, 7*c*, and 7*d*), and these heat exchange portions 7*a* to 7*d* are aligned in the vertical direction. The heat exchanger 7 has three bend portions (portions at which end portions of the heat exchange portions are connected to each other). The heat exchanger 7, that is, the heat exchange portions 7*a* to 7*d* include fins 71 and heat-transfer pipes 72. The fins 71 are stacked in the horizontal direction such that gaps through which air flows are formed.

The heat exchanger 7 according to Embodiment 3 is structured such that each of the heat exchange portion 7*a* at the uppermost portion the heat exchange portion 7*d* at the lowermost portion which are arranged perpendicularly to the air inflow direction in the Embodiment 1 is arranged so as to be bent in a substantially L shape in which one portion thereof extends in the vertical direction and the other portion thereof bends in the air suction direction or air blowout direction, and allows the mounting volumes of the heat exchange portion 7*a* and the heat exchange portion 7*d* to be increased as compared to the case where these heat exchange portions are arranged perpendicularly to the air suction direction. Thus, in the outdoor unit 50 configured in Embodiment 3, similarly to Embodiments 1 and 2, it is possible to increase the mounting volume of the heat exchanger 7 while a decrease in the heat exchange performance of the heat exchanger 7 which is caused due to the wind speed distribution is suppressed, as compared to the existing outdoor unit. In addition, it is possible to further increase the mounting volume of the heat exchanger 7 as compared to Embodiment 1. Moreover, even when the air volume is increased in response to an increase in the mounting volume of the heat exchanger 7, the air flow area of the heat exchanger 7 is also increased at the same time, and thus an increase in the speed of air flowing through the heat exchanger 7 is suppressed, and it is possible to efficiently improve the heat exchange performance of the heat exchanger 7 without causing an increase in air flow resistance.

As shown in FIG. 9, the heat exchange portion 7*a* located at the uppermost portion of the heat exchanger 7 according to Embodiment 3 and the heat exchange portion 7*d* located at the lowermost portion of the heat exchanger 7 are arranged perpendicularly to the air suction direction in which air is sucked through the air inlet 6 in the outdoor unit 50. Thus, the resistance applied to air flowing through the heat exchange portion 7*a* and the heat exchange portion 7*d* is reduced, and the air easily passes through the heat exchange portion 7*a* and the heat exchange portion 7*d*. As a result, it is possible to keep a wind speed distribution in the heat exchanger 7 uniform.

In Embodiment 3, the number of bends in the heat exchanger 7 (i.e., the number of connection portions between the heat exchange portions constituting the heat exchanger 7) is three, but is not limited to this number. For example, the number of bends in the heat exchanger 7 may be four or more. In addition, the number of the heat exchange portions of the heat exchanger 7 that are arranged in a zigzag shape is also not limited. In this case, the air flow resistance is also increased, and thus it is better to appropriately select specifications of the heat exchanger 7 such as thinning the heat exchanger 7.

In addition, in Embodiment 3, each heat exchange portion is arranged such that the connection portion between the heat exchange portion 7*a* and the heat exchange portion 7*b* and the connection portion between the heat exchange portion 7*c* and the heat exchange portion 7*d* are close to the air inlet 6, but the arrangement of these heat exchange portions is not limited to this arrangement. For example, as shown in FIG. 10, the heat exchanger 7 may be inverted along the air flow direction, and each heat exchange portion may be arranged such that the connection portion between the heat exchange portion 7*b* and the heat exchange portion 7*c* is close to the air inlet 6.

Embodiment 4

In the outdoor units 50 shown in Embodiments 1 to 3, for example, a fan 4 as described below may be used. It should be noted that the matters which are not particularly described in Embodiment 4 are the same as in Embodiments 1 to 3, and the same functions or components are described with the same reference signs.

Figure 11:
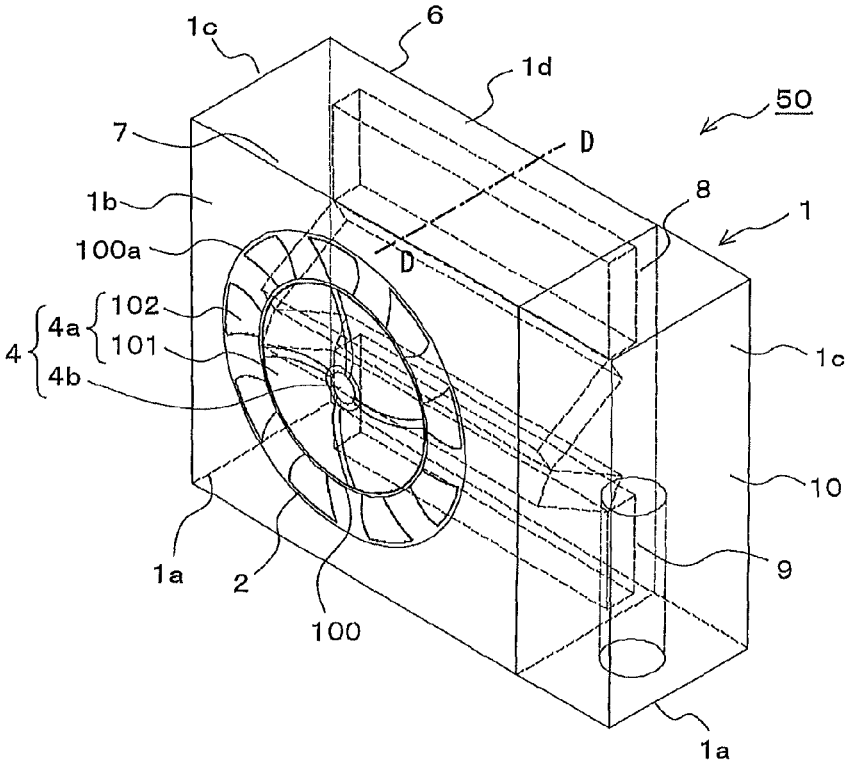
FIG. 11 is an external perspective view showing an outdoor unit for an air-conditioning apparatus according to Embodiment 4 of the present invention.

FIG. 11 is an external perspective view showing an outdoor unit 50 for an air-conditioning apparatus according to Embodiment 4 of the present invention. In addition, FIG. 12 is a schematic cross-sectional view taken along a line D-D in FIG. 11.

Figure 12:
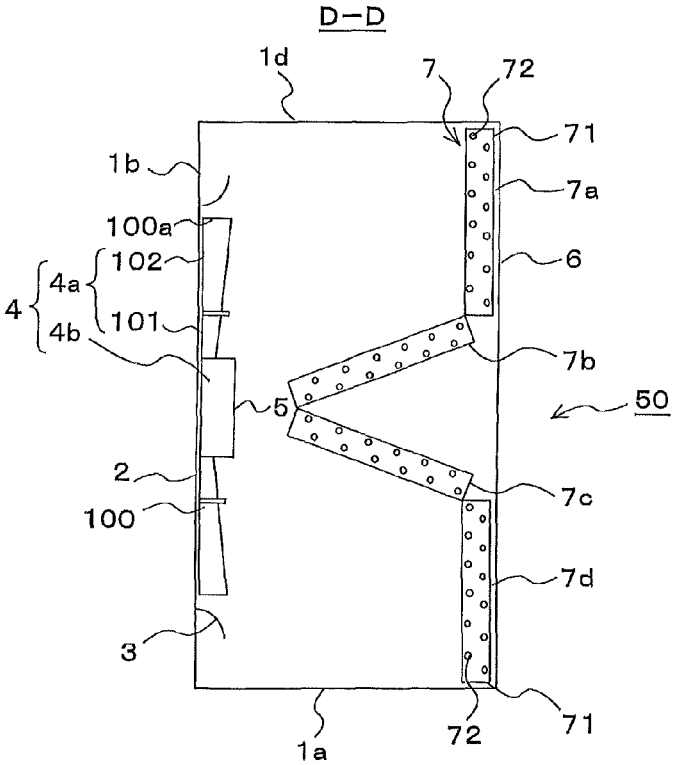
FIG. 12 is a schematic cross-sectional view taken along a line D-D in FIG. 11.

As shown in FIGS. 11 and 12, in the fan 4 according to Embodiment 4, an intermediate ring 100 is formed at substantially intermediate portions of the vanes 4*a* and connects the adjacent vanes 4*a*. More specifically, the vanes 4*a* include inner peripheral vanes 101 between the boss 4*b* and the intermediate ring 100 and outer peripheral vanes 102 provided at the outer peripheral side of the intermediate ring 100. In addition, as shown in FIG. 12, the positions of the connection portion (bend portion) between the heat exchange portion 7*a* and the heat exchange portion 7*b* and the connection portion (bend portion) between the heat exchange portion 7*c* and the heat exchange portion 7*d* substantially coincide with the position of the intermediate ring 100 in the direction in which the heat exchange portions are aligned.

In the outdoor unit 50 configured as in Embodiment 4, the following advantageous effects are provided in addition to the advantageous effects shown in Embodiments 1 to 3. The fans 4 shown in Embodiments 1 to 3 are configured such that the thickness thereof in the rotation axis direction is decreased by decreasing the widths of the vanes 4*a* and increasing the number of the vanes 4*a*. In Embodiment 4, the number of the outer peripheral vanes 102 is made larger than the number of the inner peripheral vanes 101 to ensure aerodynamic performance of the fan 4. In addition, in the fan 4 of Embodiment 4, it is possible to enhance the strength of the base of each vane 4*a* by connecting the vanes 4*a* to each other via the intermediate ring 100, and thus it is possible to further decrease the widths of the vanes 4*a* and increase the number of the vanes 4*a*. Therefore, the fan 4 shown in Embodiment 4 allows the thickness thereof in the rotation axis direction to be decreased as compared to the fans 4 shown in Embodiments 1 to 3.

Since the axial thicknesses of the vanes 4*a* of the fan 4 are further decreased as described above, a space for mounting the heat exchanger 7 is increased within the outdoor unit 50, and thus it is possible to increase the mounting volume of the heat exchanger 7. In addition, although air is relatively less likely to flow near the bend portions (connection portions between the adjacent heat exchange portions) of the heat exchanger 7, since the positions of the bend portions substantially coincide with the position of the intermediate ring 100 where there is no vanes 4*a*, it is possible to prevent a decrease in the aerodynamic performance of the fan 4 which is caused due to the provision of the intermediate ring 100. Furthermore, since air does not flow into the intermediate ring 100, an increase in noise which is caused due to disturbance by interference between sucked air and the intermediate ring 100 does not occur. As described above, it is possible to reduce the thickness of the fan 4 and increase the mounting volume of the heat exchanger 7 without causing a decrease in the aerodynamic performance of the fan 4 and an increase in noise.

It should be noted that the example where the ring (intermediate ring 100) is provided at substantially the intermediate portions of the vanes 4*a* and connects the adjacent vanes 4*a* has been shown in the above description, but as a matter of course, a ring (outer peripheral ring 100*a*) may be provided at outer peripheral portions of the vanes 4*a* (outer peripheral portions of the outer peripheral vane 102) and may connect the adjacent vanes 4*a*. In this case, it is possible to further enhance the strength of the vanes 4*a*.

In Embodiment 4, all the bend portions (connection portions between the heat exchange portions) of the heat exchanger 7 close to the fan 4 are caused to substantially coincide with the position of the intermediate ring 100 in the direction in which the heat exchange portions are aligned. However, it is possible to obtain the above advantageous effects by causing at least one of these bend portions to substantially coincide with the position of the intermediate ring 100.

In Embodiments 1 to 4 described above, the case where the heat exchanger 7 is arranged at the windward side of the fan 4 has been shown, but the heat exchanger 7 may be arranged at the leeward side of the fan 4. For example, in the case of the outdoor unit 50 shown in Embodiment 1, air may be sucked from the front panel 1*b* side, supplied to the heat exchanger 7 at the leeward side, and blown out through the upper or lower surface of the outdoor unit 50. In this case, a heat transfer enhancement effect is also obtained which is caused by collision of airflow, blown out from the fan 4 having a high wind speed, against the heat exchanger 7, and thus there is an effect of further improving the heat exchange performance of the heat exchanger 7.

In Embodiments 1 to 4, the example of the present invention has been shown with, as an example, the fan 4 including the fan motor 5 provided within the boss 4*b*, but the present invention is not limited thereto, and an external motor mounted so as to project from the boss 4*b* in the rotation axis direction may be used as a fan motor.

The invention claimed is:

1. An outdoor unit for an air-conditioning apparatus, the outdoor unit comprising:

a heat exchanger;

a fan;

a compressor; and a box-like casing housing the heat exchanger, the fan, the compressor, the box-like casing having an air inlet and an air outlet, wherein the heat exchanger includes a plurality of heat exchange portions arranged in an air passage formed between the air inlet and the air outlet, and the heat exchanger has at least three bend portions to have a zigzag shape, and the fan and the heat exchanger are opposed to each other in a horizontal direction, and the plurality of heat exchange portions are arranged in a zigzag shape along a vertical direction, and the heat exchange portions, located at an uppermost portion thereof and a lowermost portion thereof, of the plurality of heat exchange portions, are arranged perpendicularly to an air suction direction.

2. The outdoor unit for an air-conditioning apparatus of claim 1, wherein a projection portion of the zigzag shape is located at a portion opposed to the fan.

3. The outdoor unit for an air-conditioning apparatus of claim 1, wherein each of the heat exchange portions located at the uppermost portion and the lowermost portion is formed in an L shape in which one portion thereof extends in a vertical direction and an other portion thereof bends in the air suction direction or in an air blowout direction.

4. The outdoor unit for an air-conditioning apparatus of claim 1, wherein an uppermost end portion of one, located at the uppermost portion, of the heat exchange portions, and a lowermost end portion of another one, located at the lowermost portion, of the plurality of heat exchange portions, are arranged at a downstream side of other portions of the heat exchange portions in an air flow direction.

5. The outdoor unit for an air-conditioning apparatus of claim 1, wherein the fan includes a plurality of vanes, a boss, and a motor, and the motor is provided within the boss.

6. The outdoor unit for an air-conditioning apparatus of claim 1, wherein the fan includes a plurality of vanes, a boss, and a motor, and an outer peripheral ring is formed at outer peripheral portions of the vanes and connects the adjacent one of the vanes.

7. The outdoor unit for an air-conditioning apparatus of claim 1, wherein the fan includes a plurality of vanes, a boss, and a motor, and Reference Signs List

| | | | | | | | | | |
|---|---|---|---|---|---|---|---|---|---|
| 1 | casing | 1a | base plate | 1b | front panel | 1c | side panel | | |
| 1d | top plate | 2 | air outlet | 3 | bell mouth | 4 | fan | 4a | |
| vane | 4b | boss | 5 | fan motor | 6 | air inlet | 7 | heat | |
| exchanger | 7a to 7f | heat exchange portion | | 8 | partition plate | 9 | | | |
| compressor | 10 | machine chamber | 50 | outdoor unit | 71 | fin | 72 | | |
| heat-transfer pipe | 100 | intermediate ring | 100a | outer peripheral ring | | | | | |
| 101 | inner peripheral vane | 102 | outer peripheral vane | | | | | | |

an intermediate ring is formed between outer peripheral portions of the vanes and the boss and connects adjacent ones of the vanes.

8. The outdoor unit for an air-conditioning apparatus of claim 7, wherein a height position of the intermediate ring and a height position of the bend portion of the heat exchanger coincide with each other.

9. The outdoor unit for an air conditioning apparatus of claim 1, wherein a thickness of the plurality of heat exchange portions which are arranged in a zigzag shape along a vertical direction is thinner than a thickness of the heat exchange portions located at an uppermost portion and a lowermost portion of the plurality of heat exchange portions.

* * * * *